United States Patent [19]

Jevons

[11] 4,049,274

[45] Sept. 20, 1977

[54] MOTORCYCLE TEAM RACING GAME

[76] Inventor: Cecil F. Jevons, 2706 J Ave., Anacortes, Wash. 98221

[21] Appl. No.: 663,778

[22] Filed: Mar. 4, 1976

[51] Int. Cl.[2] ..... A63F 3/00

[52] U.S. Cl. ..... 273/134 CA; 273/134 AT

[58] Field of Search ..... 273/86, 134

[56] References Cited

U.S. PATENT DOCUMENTS

| | | | |
|---|---|---|---|
| 3,231,279 | 1/1966 | Howarth et al. | 273/134 CB |
| 3,954,268 | 5/1976 | Zyla | 273/134 CA |

FOREIGN PATENT DOCUMENTS

| | | | |
|---|---|---|---|
| 1,266,949 | 3/1972 | United Kingdom | 273/134 CA |
| 1,288,071 | 9/1972 | United Kingdom | 273/134 CA |

*Primary Examiner*—Delbert B. Lowe
*Attorney, Agent, or Firm*—Robert B. Hughes

[57] ABSTRACT

A game having a game board representing a cross-country motorcycle race path. Each player has three markers, each representing a motorcycle and rider, each of which is a "team member" belonging to that player; also there are three breakdown counters, one for each team member. By throwing dice, each player moves his team members along the race path, always maintaining the members in a predetermined order of progress, with the numbers on the dice determining the distance moved. Along the path are various obstacles and diversions. Each player is able to selectively move his several team members in a strategic manner to maximize progress of his team members and impede progress of the motorcycle team members of an opposing player.

12 Claims, 5 Drawing Figures

HIT A LOG
LOSE ONE TURN
32
DIRT IN CARBURETOR
LOSE THREE TURNS
BRAKES WENT OUT
LOSE ONE TURN
BROKEN CHAIN
LOSE TWO TURNS
FLAT TIRE
LOSE FOUR TURNS
FOULED SPARK PLUG
LOSE ONE TURN
POINTS NEED FILING
LOSE TWO TURNS

CYCLE #1
CYCLE #2
CYCLE #3
BREAK DOWN COUNTER
RED
BLUE
GREEN
YELLOW
38
40
42
44
46

48
48a
48b
48c
48d
MOTORCYCLE SET RED
MOTORCYCLE SET BLUE
MOTORCYCLE SET GREEN
MOTORCYCLE SET YELLOW

50

MOTORCYCLE TEAM RACING GAME

BACKGROUND OF THE INVENTION

1. Field of the Invention

The present invention relates to a racing game, particularly a racing game where the racing markers can be operated selectively and strategically to maximize progress of one player's markers and minimize progress of the markers of opposing players.

2. Description of the Prior Art

There are in the prior art a variety of racing games arranged to simulate conditions encountered in an actual race. The usual ingredients of such a game are: (a) a game board representing some sort of race path, (b) a marker for each player to be moved along the race path, (c) chance means, such as dice or a spinner, to provide a chance determined number to indicate the amount of travel of the marker, and (d) some sort of obstacle or obstacles to impede progress of the markers, sometimes on a chance basis.

One such game is disclosed in U.S. Pat. No. 2,577,961, Graves, where there is a game board indicating an automobile race track around which several automobile markers "race" to come in first at the finish line, with the path being obstructed with repair shop squares, crack-up squares and the like. The patent indicates the desirability of eliminating the necessity of each player having to wait his turn. Accordingly, this game provides a spinner so arranged that on each spin a plurality of different numerical values come up, one for each player in the game. Thus, after each spin of this spinner, all the players are able to move their markers, but at different distances in accordance with the different numerical values indicated for the players.

A racing game similar to that of the Graves patent is disclosed in U.S. Pat. No. 3,044,779, Hvizdash. The game board displays a track having a plurality of parallel paths on an oval track. Cards are drawn to determine progress and impediments to progress of each of the markers moving around the oval track.

U.S. Pat. No. 2,231,279, shows another form of an automotive racing game in which each player can select the "speed" at which his automobile marker moves around the track. The "risk" element comes about when the automobile marker arrives at a curved area of the track at a rate of speed above the safe level at which the curve can be negotiated. Then the player throws the dice to determine the possible penalty or consequences of the overspeed condition. Since as a practical matter it is not possible to win the game by always maintaining a "safe speed", the element of chance largely determines the actual success of the player.

U.S. Pat. No. 3,738,659, adds another facet to the racing game, in requiring the player to first "purchase" the various parts of the automobile, which when assembled permits the player to begin racing. This game involves randomly distributable monetary units and play directing cards which again are picked up in a random sequence by the players.

U.S. Pat. No. 3,834,709, Lamb, discloses a game simulating a Greyhound race. There are a plurality of paths, one for each Greyhound marker. These paths meet and intersect at various locations, so that the progress of one Greyhound marker can impede the progress of a second Greyhound marker at the point of meeting or intersection. Dice are used to advance the markers along their respective paths.

U.S. Pat. No. 3,851,881 is intended to simulate the hazards of traveling the subway system of a large city. The gameboard represents the subway system of a city, and each player starts on a train at a particular starting point and wins the game by successfully returning to the starting point. Progress is determined by the number which turns up on a spin of the wheel, and there are instruction cards received in some random manner giving various instructions related to the player's progress over the board.

While the prior art racing games do attempt to inject a certain amount of interest or excitement by adding features which simulate or represent features encountered in actual race or travel situations, the success or failure of the participants is still due largely, if not almost entirely, to the element of chance, as determined by the throw of the dice, the turn of the spinner, or the draw of a card. In view of this, it is an object of the present invention to provide a racing game which incorporates the element of racing strategy together with the element of risk inherent in racing. More specifically, this is accomplished by providing a game incorporating team racing where each player has a racing team made up of a plurality of individual racing members or markers which are advanced selectively along the race course while maintaining a predetermined order of progress. Progress of the individual racing markers or members is determined partly by chance, e.g., by a throw of the dice, and partly by strategy in selecting the member to be moved, this being done in accordance with certain game rules to maximize progress of the player's own team members, while minimizing progress of the opposing team members.

It is another object of the present invention to provide a game which simulates the strategy and hazards of team racing of motorcycles along a cross-country course. The hazards incorporate not only delays such as breakdowns, pile-ups, collisions with natural obstacles, etc., but also incorporate diversions where a team member is misdirected from the shortest through route by being directed to a portion of the course already traveled. The strategic element is incorporated by the player selectively moving his individual members to avoid obstacles and also in a manner such that the progress of a rearwardly positioned member is not impeded by a forward member of the same team (which the rearwardly positioned member is not allowed to pass). Also, strategy is involved in positioning the individual team members with respect to squares occupied by opposing team members.

SUMMARY OF THE INVENTION

The game of the present invention is intended to incorporate both the strategy and risk elements in team racing, and specifically team racing as applied to motorcycle racing over a cross-country course. Each player has a set of team members which are moved along the race course. For clarity each team member will simply be referred to as a "motorcycle" in the description that follows. In the specific form of the game disclosed herein, each player has on his team three motorcycles which the player advances along a race course in a predetermined order which must be maintained throughout the race. The number of increments of travel (i.e. spaces or squares which a motorcycle may progress along the race path) is determined by chance (e.g., a throw of the dice). However, since only one motorcycle of a team may be moved on any one turn, part of the strategy of the game is in properly positioning the motorcycles so that the progress of a forward motorcycle does not impede the progress of a rearwardly positioned motorcycle of the same team. Further strategy is involved in positioning motorcycles so as to impede opposing motorcycles, and moving one's motorcycle selectively to avoid obstacles.

The game comprises a board having a representation of an obstacle encumbered track, such as a cross-country motorcycle course, this track being divided along its length into increments of travel (i.e., spaces or squares). There are a plurality of sets of markers, (specifically motorcycle figures), with each set having a common identifying means, such as a common color coding, to identify the markers of that set as the motorcycles of the team of a particular player.

The board is also provided with delay indicating means, such as breakdown squares, pile-up squares, obstruction squares, etc., and also diversions which direct the member from the path to a rearwardly spaced location on the race path. In the preferred form, there are incorporated with the delay indicating means cards which are randomly selected to add a further element of chance to the delay encountered. In the preferred form, these are breakdown cards which indicate the nature of the breakdown and the number of turns which are missed.

So that the various breakdowns and/or delays can be correlated with the individual motorcycles of each set, there is additionally provided a plurality of sets of delay counters (i.e., breakdown counters). Each set of counters is desirably on a single breakdown board, one breakdown board being provided for each player, and each counter of each board corresponding to a particular motorcycle team member. The game further incorporates number indicating chance means, operable by a player to indicate a numerical value to determine the amount of progress of a selected motorcycle along the race path. In the preferred form, this chance means is a pair of dice, so that delays and release from delays on the race course can be determined in part by a particular combination of numbers on the dice, such as "doubles".

Other features of the present invention will become apparent from the following detailed description.

DESCRIPTION OF THE PREFERRED EMBODIMENT

Figure 1:
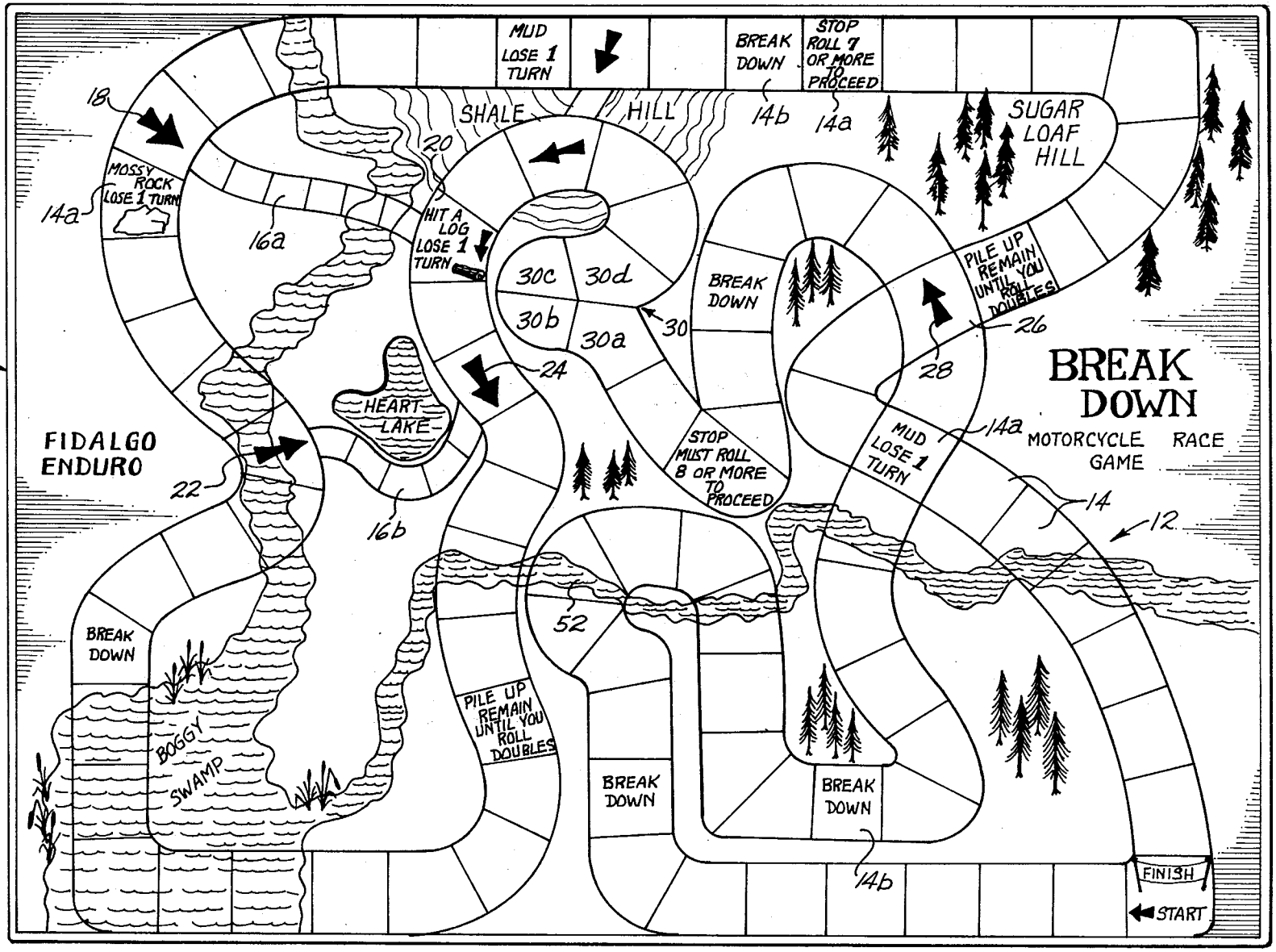
FIG. 1 is a top plan view of a game board of the present invention.

In FIG. 1, there is shown a flat playing board 10 representing a natural landscape made up of hills, lakes, swamps, streams and trees. The board also has on its surface a closed race course 12 represented as a circuitous path over the surface of the board. The length of the course 12 is divided linearly by transverse lines into a plurality of travel increments (i.e., spaces or squares 14).

It will be noted that the race course 12 is encumbered with various obstacle squares. Some of these are natural obstacles such as mud, a log or a rock, and some are race hazards such as a pile-up, with these squares designated **14*a*. Additionally, there are a number of squares identified as "breakdown" squares, indicated at 14*b*. As a further complication in the race course, there are two sets of diversion paths, 16*a* and 16*b*, each of which extends from a forward location on the race path to a rearward location on the race path. Specifically, the path 16*a* extends from a square having a diverting arrow 18 to a second square 20 having a log obstacle. The second diversion path 16*b* extends from a square having second diverting arrow 22 to a rearwardly positioned square having another arrow 24 directed along the forward course of travel on the race course. Further, the race course itself crosses back over itself at a location indicated at 26. At one location of the cross area 26 there is a diverting arrow 28 which represents a diversion onto a rearward portion of the race course. At another location of the race course, indicated at 30, four squares, indicated 30*a*, 30*b*, 30*c* and 30*d* are grouped together in a rectangular pattern which permits travel directly across two of the squares 30*a* and 30*d*, or permits more circuitous travel over all four squares 30*a* through 30*d***.

An over all examination of the board 10 reveals that the character of this race course simulates a cross-country motorcycle race course. The course itself is circuitous and travels through a variety of landscapes. There are natural obstacles, racing obstacles and breakdown hazards. The path has a crossover 26, a short cut or long cut area 30, and two diversion paths **16*a* and 16*b***, such as might occur in an actual cross-country race course.

Figures 2, 3, 4, 5:
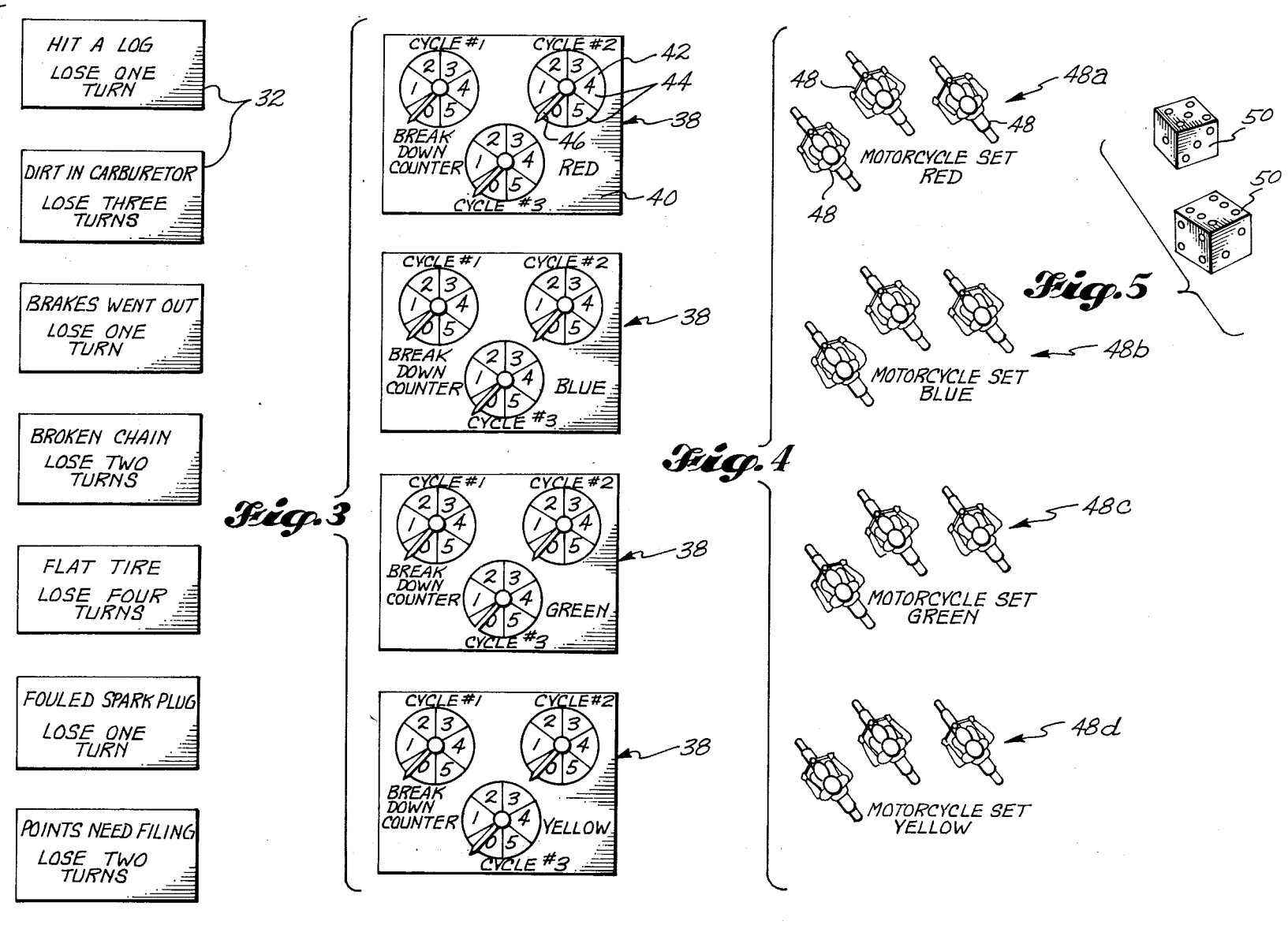
FIG. 2 illustrates a number of the breakdown cards of the game of the present invention.
FIG. 3 is a top plan view of the breakdown counters of the game.
FIG. 4 is a view of the several motorcycle sets which are moved along the race course of the game board during game play.
FIG. 5 is a view of a pair of dice used to advance individual motorcycle members or markers.

In FIG. 2, there is shown a sampling of breakdown cards 32 which are used in association with the breakdown squares **14*b***. Each breakdown card has printing which indicates first the cause or nature of the breakdown, and a second set of printing which indicates how many turns the player loses as a result of the breakdown. As will be disclosed more fully hereinafter in a description of the play of the game, each time a motorcycle lands on a breakdown square, the player responsible for that motorcycle draws a card and that motorcycle must suffer the consequences indicated on the breakdown card.

In FIG. 3, there are shown four sets 38 of breakdown counters. Each set comprises a supporting board or card 40 supporting three individual counters 42. Each counter 42 comprises an underlying circle having six arcuate segments 44 having in clockwise sequence numerals one through six. Additionally, each counter 42 has a pointer 46 which can be moved to the number on any one of its segments 44. Each of the boards or cards 40 of each counter 38 is color coded (e.g., red, blue, green or yellow) to identify that counter as belonging to a particular team (i.e., a group of motorcycles) selected by a player.

In FIG. 4, there are illustrated four sets of markers or motorcycle team members 48. One set, identified as **48*a* is colored red, the second set 48*b* is colored blue, the third set 48*c* is colored green, and the fourth set 48*d* is colored yellow. Each counter 42** is identified (i.e., "cycle 1" or "cycle 2") to correspond to a related motorcycle member of its racing team.

Finally, in FIG. 5, there is shown a pair of dice 50 which function as a chance means operable by a player to indicate a numerical value acquired by chance to determine the rate of progress of team members along the race course 12. Within the broader concept of the present invention, other chance means can be used. However, the preferred form is the pair of dice 50, since certain combinations of the pair of dice 50 can influence the play. For example, as will be disclosed more fully hereinafter, by throwing a pair of "doubles", a player is able to move off a square occupied also by a motorcycle of an opposing team.

The operation or method of playing the game of the present invention will now be described. Since this game is especially adapted to simulate the character of a cross-country motorcycle team race, the play will be described specifically in those terms. However, it is to be understood that within the broader aspects of the present invention, the use of such terminology is not intended to limit the game components to that specific form.

The object of the game is to run all three of a player's motorcycles 48 around the track 12 before any one of his opponents is able to do so. To begin the game, each player picks the color of his motorcycle team (48*a, b, c,* or *d*) and places one of his motorcycles 48 on the square marked "START-FINISH". The breakdown cards are placed in a stack face down on the board. Each player then rolls the dice 50, with the high roller beginning the game.

The high roller then rolls the dice 50 again and moves his first motorcycle 48 in a forward path of travel along the course 12 the number of squares indicated by the sum of the two numbers appearing on the dice 50. Then the next opponent who has rolled the second highest number on the dice 50 does the same. After a player's first motorcycle 48 crosses the creek 52, at the twelfth square from the starting square, that player may begin his second motorcycle 48 on the path of travel. When his second motorcycle 48 has passed the creek 52, that player may then start his third motorcycle 48. A player may move any one of his three motorcycles 48 on any roll of the dice 50, except that one motorcycle 48 of a team may not pass another motorcycle 48 of the same team or land on the same square as a motorcycle 48 of the team.

Throughout the course of the game, each of the players take turns in the same sequence, each turn comprising rolling the dice 50 once. When a motorcycle 48 of one team lands on the same square 14 as a motorcycle 48 of another team, both motorcycles 48 must remain on that same square 14 until one of the players controlling one of the two motorcycles rolls "doubles" and moves his motorcycle 48 from that square the number of spaces or squares 14 indicated on the dice. However, if that player rolls doubles and chooses not to move his motorcycle 48 occupying the same square 14 as the opponent's motorcycle 48, both motorcycles 48 must remain on that square 14 until another "doubles" is rolled by one of the two players whose motorcycles 48 are occupying that same square. As a strategic move, a player may purposely move one of his motorcycles 48 onto a square occupied by an opponent's motorcycle 48 to hold up the opponent's motorcycle 48. A player must move a single motorcycle 48 the full number of spaces corresponding to the number shown on the dice.

To add interest and stimulate the risks and hazards of an actual motorcycle race, various complicating factors are injected into the play. When a motorcycle lands on a "BREAKDOWN" square 14*b,* the player must draw a "BREAKDOWN" card 32 and follow instructions. For example, if the instructions say that the player loses two turns, then the player cannot move that particular motorcycle 48 for two turns. However, if he has two other motorcycles which that player is able to move, the player must move one of the two free motorcycles rather than lose his roll on the dice 50. If a player has two of his motorcycles 48 encumbered so that they are not able to move, then on that player's turn to roll the dice 50, he must move the free motorcycle the number of spaces indicated on the throw of the dice 50.

So that the status of each motorcycle 48 of a team can be kept current, the player uses his "BREAKDOWN" counter set 38. For example, if motorcycle number two lands on a "BREAKDOWN" square 14*b,* and if the "BREAKDOWN" card 32 that is drawn indicates that two turns are lost, the pointer 46 of the counter 42 corresponding to motorcycle number two is moved to numeral two on the counter 42. At the player's next turn, the pointer 46 is moved to number one, and on the next turn back to zero, this indicating that motorcycle number two is free to move on the next turn.

When a motorcycle 48 lands on a square through which a creek passes, that individual motorcycle 48 is not able to move on the next turn, and this is also indicated by means of the "BREAKDOWN" counter 38. When a motorcycle 48 lands on a square through which the swamp passes, that motorcycle 48 loses one turn, unless the player has the good fortune of rolling "doubles" on his next turn. When a motorcycle 48 lands on any square that has a natural barrier square 14*a,* such as mud or a mossy rock, the player must follow the instructions indicated on that square 14*a* with respect to that particular motorcycle 48.

When a motorcycle 48 comes to one of the two hills indicated on the board, the motorcycle must stop on the square 14*a* marked "STOP", even if the roll of the dice indicated a number higher than required to get over the hill. The motorcycle then follows the instructions on that particular square 14*a* indicated as "STOP". If two motorcycles 48 of different teams land on the same "STOP" square 14*a,* each motorcycle may move off that square 14*a* without rolling "doubles", provided the instructions in that particular square 14*a* are followed. When a motorcycle 48 is moved so that it comes to rest on a square 14 containing an arrow, that motorcycle 48 must travel in the direction the arrow points.

After a motorcycle 48 passes over "SUGAR LOAF HILL" and is on one of the last six spaces from the creek 52 to the "FINISH" square, that player must throw "doubles" larger than the number of squares required, or that player must roll the exact number required to land on the "FINISH" square in order for that particular motorcycle 48 to finish the race. However, if the motorcycle has not yet reached the creek, that particular motorcycle may proceed to the "FINISH" square, if the player rolls a number on the dice 50 high enough to reach the "FINISH" square or if the number on the dice 50 is higher than the number required to reach the "FINISH" square. For example, if a particular motorcycle 48 is on the ninth square 14 from the "FINISH" line, a throw on the dice 50 of the number nine or higher enables that particular motorcycle 48 to travel to the "FINISH" square and complete the race. However, if a motorcycle is on the third square 14 from the "FINISH", the player must throw a "doubles" of the numeral two or higher, or roll exactly the numeral three to finish.

From the foregoing description of the method of playing the game, it can readily be recognized that in addition to the element of chance determining the progress of the motorcycles 48 of a team through the race, as determined by the dice 50, there are also substantial elements of strategy involved. For example, a player must take care to position his motorcycles 48 a sufficient distance apart so that he has adequate freedom of movement of the several motorcycles 48 to avoid being forced into obstacles. On the other hand, since the player can only win by having all three of his motorcycles 48 complete the race, the spacing of motorcycles 48 along the course cannot become too great. Additionally, the player can select the movements of his motorcycles 48 to land on the same squares 14 of some of his opponents' motorcycles 48, so as to force one of the free motorcycles 48 of his opponent to move through a hazardous area.

What is claimed is:

1. A game to simulate team racing, such as cross-country motorcycle team racing, where each player is able to operate selectively members of the player's team along a race course, while maintaining a predetermined order of the team members, with an element of chance to simulate delays and hazards of racing, and with elements of strategy by which the player can attempt to maximize progress of the player's own team members and minimize progress of team members of another player, said game comprising:

a. a board having a representation of an obstacle encumbered race course, such as a cross-country motorcycle course, said race course being divided along its length into increments of travel, such as squares, b. a plurality of sets of markers, such as figures of a motorcycle team, each set having identification means, such as a color coding, to identify the markers of that set belonging to a particular player, c. said board having turn delay indicating means, such as breakdown squares, natural hazard squares or racing obstacle squares, to indicate a delay in progress of a marker encountering the delay indicating means by loss of one or more turns, d. chance means, such as dice, operable by a player to provide by chance a numerical value to determine the extent of progress of a selected marker along said race course, and e. a plurality of sets of turn delay counters, such as breakdown counters, said sets of counters corresponding to related sets of markers, with each set of counters having an individual counter for each marker of its related set of markers, so that as play progresses, it is possible to count off the number of turns that are lost as a result of a marker encountering said delay indicating means, and to associate the delay in turns with a particular marker of a particular player.

2. The game as recited in claim 1, wherein said game further comprises a plurality of progress delaying cards, such as breakdown cards, each of said cards indicating a delay in turns of a predetermined value and further indicating a cause for such delay corresponding to a realistic condition encountered in the race simulated by the game.

3. The game as recited in claim 1, wherein said board has on its race course at least one diverting path extending between locations of the course spaced from one another along the length of the course, said board further comprising indicating means on the race course to divert a marker from said course along said diversion path.

4. The game as recited in claim 1, wherein said board has two course portions which intersect each other at a location, with diversion indicating means at said location of intersection, whereby a marker landing on such diversion indicating means is directed from one portion of the course onto another portion of the course.

5. The game as recited in claim 1, wherein said board has representations of various natural obstacles encountered in a cross-country race, such as hills, swamps, streams, rocks, logs and the like.

6. The game as recited in claim 1, wherein said board has on the course more than two squares adjoining each other with at least one square having a boundary to at least two other squares, whereby a marker may be moved across said boundary to either square to lengthen or shorten the path of travel of that particular marker.

7. The game as recited in claim 1, wherein each set of turn delay counters comprises a plurality of counters, each of which comprises a rotatably mounted pointer and a set of angularly spaced numerical designations.

8. The game as recited in claim 1, wherein said chance means comprises a pair of dice, whereby predetermined combinations of dice, such as equal numbers appearing on the dice, facilitates progress of an otherwise inhibited marker, so as to simulate an element of chance in one marker being able to move away from another on the race course.

9. The game as recited in claim 1, wherein said board has on its race course at least one diverting path extending between locations of the course spaced from one another along the length of the course, said board further comprising indicating means on the race course to divert a marker from said course along said diversion path, and said board having two course portions which intersect each other at a location, with diversion indicating means at said location of intersection, whereby a marker landing on such diversion indicating means is directed from one portion of the course onto another portion of the course.

10. The game as recited in claim 9, wherein said board has on the course more than two squares adjoining each other with at least one square having a boundary to at least two other squares, whereby a marker may be moved across said boundary to either square to lengthen or shorten the path of travel of that particular marker.

11. The game as recited in claim 1, wherein said game further comprises a plurality of progress delaying cards, such as breakdown cards, each of said cards indicating a delay in turns of a predetermined value and further indicating a cause for such delay corresponding to a realistic condition encountered in the race simulated by the game, and said board has representations of various natural obstacles encountered in a cross-country race, such as hills, swamps, streams, rocks, logs and the like.

12. The game as recited in claim 1, wherein:

a. said game further comprises a plurality of progress delaying cards, such as breakdown cards, each of said cards indicating a delay in turns of a predetermined value and further indicating a cause for delay corresponding to a realistic condition encountered in the race simulated by the game.

b. said board has on its race course at least one diverting path extending between locations of the course spaced from one another along the length of the course, said board further comprising indicating means on the race course to divert a marker from said course along the diversion path, c. said board has two course portions which intersect each other at a location, with diversion indicating means at said location of intersection, whereby a marker landing on such diversion indicating means is directed from one portion of the course onto another portion of the course, and d. said board has on the course more than two squares adjoining each other with at least one square having a boundary to at least two other squares, whereby a marker may be moved across said boundary to either square to lengthen or shorten the path of travel of that particular marker.

* * * * *